US009033294B2

(12) United States Patent
Cattaneo

(10) Patent No.: US 9,033,294 B2
(45) Date of Patent: May 19, 2015

(54) RELEASE PREVENTING SYSTEM FOR WALL CUPBOARDS

(75) Inventor: Carlo Cattaneo, Figino Serenza-Como (IT)

(73) Assignee: LEONARDO S.R.L., Figino Serenza-Como (IT)

( * ) Notice: Subject to any disclaimer, the term of this patent is extended or adjusted under 35 U.S.C. 154(b) by 334 days.

(21) Appl. No.: 13/138,823

(22) PCT Filed: Mar. 5, 2010

(86) PCT No.: PCT/EP2010/001601

§ 371 (c)(1),
(2), (4) Date: Oct. 3, 2011

(87) PCT Pub. No.: WO2010/121687

PCT Pub. Date: Oct. 28, 2010

(65) Prior Publication Data

US 2012/0018602 A1 Jan. 26, 2012

(30) Foreign Application Priority Data

Apr. 24, 2009 (IT) ..... MI2009A0699

(51) Int. Cl.
*A47B 95/00* (2006.01)

(52) U.S. Cl.
CPC ..... *A47B 95/008* (2013.01)

(58) Field of Classification Search
CPC ..... A47B 95/008
USPC ..... 248/221.11, 225, 11, 225.21, 250, 235, 248/301, 304, 475.1, 489, 497, 220.31, 248/339; 312/245, 246, 306
See application file for complete search history.

(56) References Cited

U.S. PATENT DOCUMENTS

| | | | | | |
|---|---|---|---|---|---|
| 3,025,122 | A * | 3/1962 | Millman | 312/245 |
| 3,337,172 | A * | 8/1967 | Jackson | 248/222.51 |
| 3,946,979 | A * | 3/1976 | Ehlebracht et al. | 248/274.1 |
| 3,989,215 | A * | 11/1976 | Weston | 248/225.11 |
| 4,143,846 | A * | 3/1979 | Rock et al. | 248/692 |
| 4,660,793 | A * | 4/1987 | Mark | 248/224.8 |
| 4,936,534 | A * | 6/1990 | Cattaneo | 248/223.41 |
| 5,116,007 | A * | 5/1992 | Von Gunton et al. | 248/243 |
| 5,351,929 | A * | 10/1994 | Vallance | 248/544 |
| 5,624,168 | A * | 4/1997 | Licciardello, Sr. | 312/245 |
| 5,718,493 | A * | 2/1998 | Nikolai | 312/245 |
| 5,988,576 | A * | 11/1999 | Ehrlich | 248/220.21 |
| 8,444,235 | B2 * | 5/2013 | Gmerek et al. | 312/245 |
| 2006/0091271 | A1 * | 5/2006 | Nowak | 248/225.21 |

FOREIGN PATENT DOCUMENTS

| | | |
|---|---|---|
| DE | 26 01 501 A1 | 7/1977 |
| EP | 0 033 179 A1 | 8/1981 |
| EP | 0 632 979 A1 | 1/1995 |

OTHER PUBLICATIONS

PCT Search Report dated Jul. 2, 2010.

* cited by examiner

*Primary Examiner* — Anita M King
(74) *Attorney, Agent, or Firm* — Hedman & Costigan, P.C.; James V. Costigan; Kathleen A. Costigan

(57) ABSTRACT

A release-preventing system for wall cupboards wherein a cupboard (40, 70, 105, 110, 150) is hooked to a support (47, 76, 97, 115, 155) fixed to the wall (48, 77, 98, 114, 154) by a hook (41, 73, 91, 125, 162) of a cupboard holding device (40, 90, 124, 163) characterized in that between the hook (41, 73, 91, 125, 162) and the support (47, 76, 97, 115, 155) there is a release preventing element (51, 79, 101, 121, 160, 167) that prevents unhooking of the cupboard.

10 Claims, 13 Drawing Sheets

RELEASE PREVENTING SYSTEM FOR WALL CUPBOARDS

CROSS-REFERENCE TO RELATED APPLICATIONS

Not Applicable

STATEMENT REGARDING FEDERALLY SPONSORED RESEARCH OR DEVELOPMENT

Not Applicable

NAMES OF PARTIES TO A JOINT RESEARCH AGREEMENT

Not Applicable

INCORPORATION-BY-REFERENCE OF MATERIAL SUBMITTED ON A COMPACT DISK OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

REFERENCE TO A MICROFICHE APPENDIX

Not Applicable

BACKGROUND OF THE INVENTION

1. Field of the Invention

The present invention relates to a release-preventing system for wall cupboards hooked to a fixed wall support, generally a suitably shaped metal bar or plate.

2. Description of Related Art

As is well known to experts in the field, a system for constraining a cupboard to the wall envisages the use of a cupboard holding device (wall brackets) comprising a hook which extends behind through the cover (if present) of the same cupboard, to be freely hooked to the above bar or plate fixed to the wall.

Cupboard holding devices of this kind are known for example from patents EP 0033179 B1 and EP 0632979 A1.

If direct forces are applied to the cupboard from the bottom upwards, the same can become unhooked from the support and fall, causing serious damage not only to objects but above all to people.

This possibility is currently even more probable as there is the increasingly frequent custom of also positioning wall cupboards at relatively low heights from the floor, which increases the above risk of accidental unhooking, especially on the part of children.

Furthermore, safety regulations have entered and are entering into force in various countries, which oblige the use of accidental release-preventing systems associated with wall cupboards.

A general objective of the present invention is therefore to provide a release-preventing system for wall cupboards, hooked to a fixed wall support, for example a shaped metallic bar, which safely prevents the undesired unhooking of said cupboard from said bar.

A further objective of the invention is to provide a release-preventing system which is simple to construct and which does not complicate the assembly of the wall cupboard.

BRIEF SUMMARY OF THE INVENTION

Another objective of the invention is to provide a release-preventing system which is easily removed i.e. which allows the cupboard to be easily and rapidly separated from the wall, in case of necessity. The above objectives are achieved, according to the invention, by a release-preventing system where the release-preventing system for wall cupboard (40, 70, 105, 110, 150) is hooked to a support (47, 76, 97, 115, 155) fixed to the wall (48, 77, 98, 114, 154) by means of a hook (41, 73, 91, 125, 162) of a cupboard holding (40, 90, 124, 163) characterized in that between said hook (41, 73, 91, 125, 162) and said support (47, 76, 97, 115, 155) are included unlacing means (51, 79, 101, 121, 160, 167) of a reciprocal tie where the unlacing means may consist of reciprocal hooking means positioned on the hook (162) and on the support (155), respectively.

BRIEF DESCRIPTION OF THE SEVERAL VIEWS OF THE DRAWINGS

The structural and functional characteristics of the invention and its advantages with respect to the known art will appear more evident from the following description, referring to the enclosed drawings, which show different possible embodiments of release-preventing systems for wall cupboards according to the innovative principles of the same invention.

DETAILED DESCRIPTION OF THE INVENTION

Figure 1:
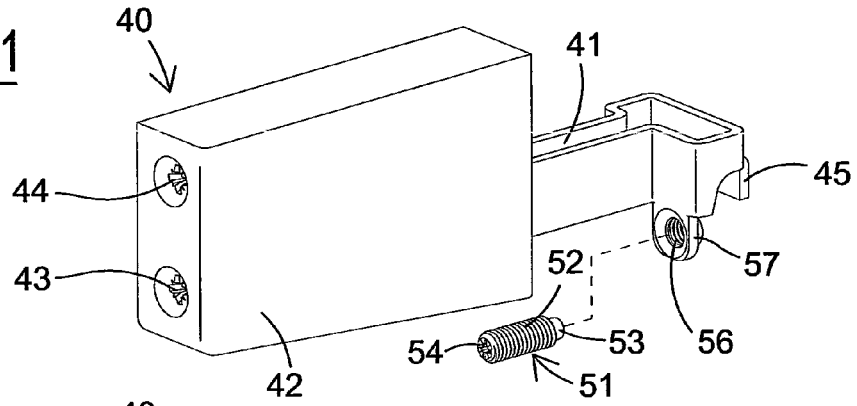
FIG. 1 is an exploded perspective view illustrating a first embodiment of a release-preventing system according to the invention.
Figure 2:
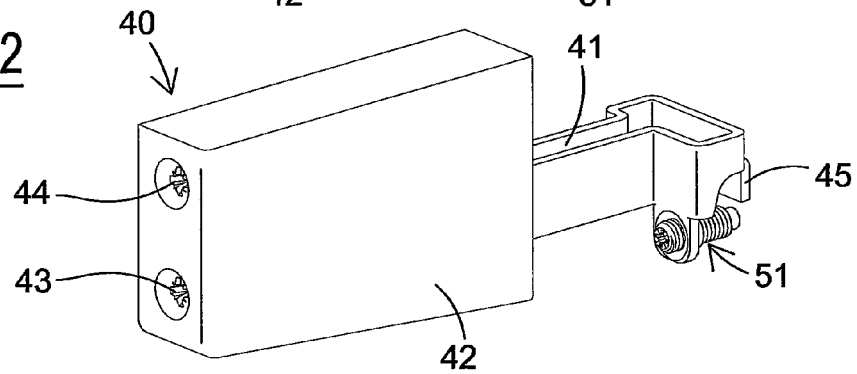
FIG. 2 is a perspective view illustrating the system of FIG. 1 assembled.

With reference first of all to FIGS. 1, 2 of the drawings, 40 indicates as a whole a cupboard holding device of the type generally known, described for example in patents EP 0033179 B1 and EP 0632979 A1, to which reference should be made for any possible explanations, and which should be considered an integral part of the present invention, such as for example cupboard holding devices of the known type.

The cupboard holding device 40 comprises a moveable hook 41 which extends from a box-shaped body 42.

A regulation mechanism (known) of the position in depth and height of the hook 41, by means of respective screws 43, 44, is enclosed inside the box-shaped body 42.

The hook 41 ends at the front with a tooth 45 destined for being hooked to a corresponding section 46 of a metallic bar 47 (FIGS. 3-8) fixed to a wall 48 by means of pegs 49. As can be clearly seen from the drawings, the section 46 of the bar 47 defines a channel 50 with the wall 48 where the tooth 45 is housed. The bar 47 has a "C"-shaped section, from whose upper wing the above section 46 extends vertically.

Characteristically, according to the invention, a release-preventing system cooperates with the tooth 45 of the hook 41, and with the bar 47, which, in the embodiment shown in FIGS. 1-8, consists of a set-screw 51 comprising a threaded section 52, a tip 53, and a shaped head 54 for a manoeuvring tool, for example a screwdriver 55.

Said set-screw 51 is screwed inside a threaded seat 56, situated on a flange 57 which extends downwards from the hook 41. The flange 57 is opposed with respect to the tooth 45, at a suitable height below it.

The cupboard holding device 40, produced as described above, is fixed to a wall cupboard partially indicated with 58 and comprising shoulders 59, a head 60 and a possible cover 61. More specifically, two of said cupboard holding devices 40 are fixed in correspondence with the upper rear edges (right and left) of said cupboard 58, only one of which is shown. The functioning of the release-preventing system according to this first embodiment of the invention is clearly illustrated in the operative sequence of FIGS. 3-8, and is briefly the following.

Figure 3:
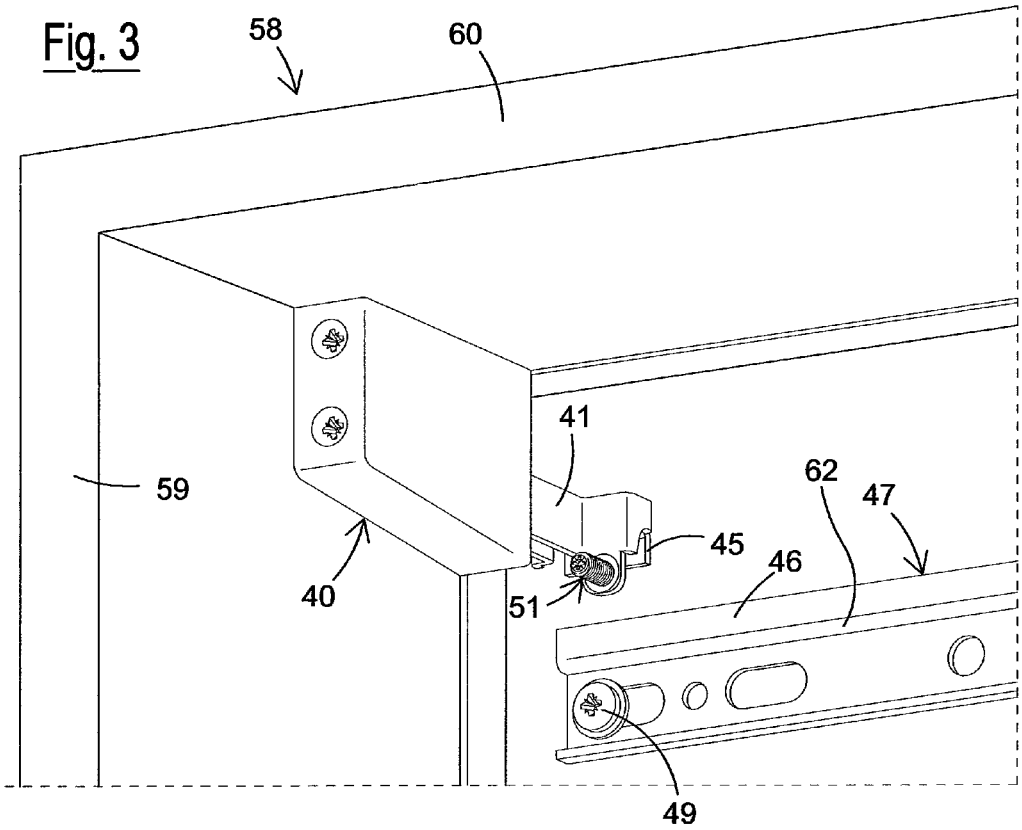
FIGS. 3 and 4 are two views illustrating the system of FIGS. 1, 2 associated with a wall cupboard in the hooking phase of the cupboard to a bar fixed to the wall.
Figure 4:
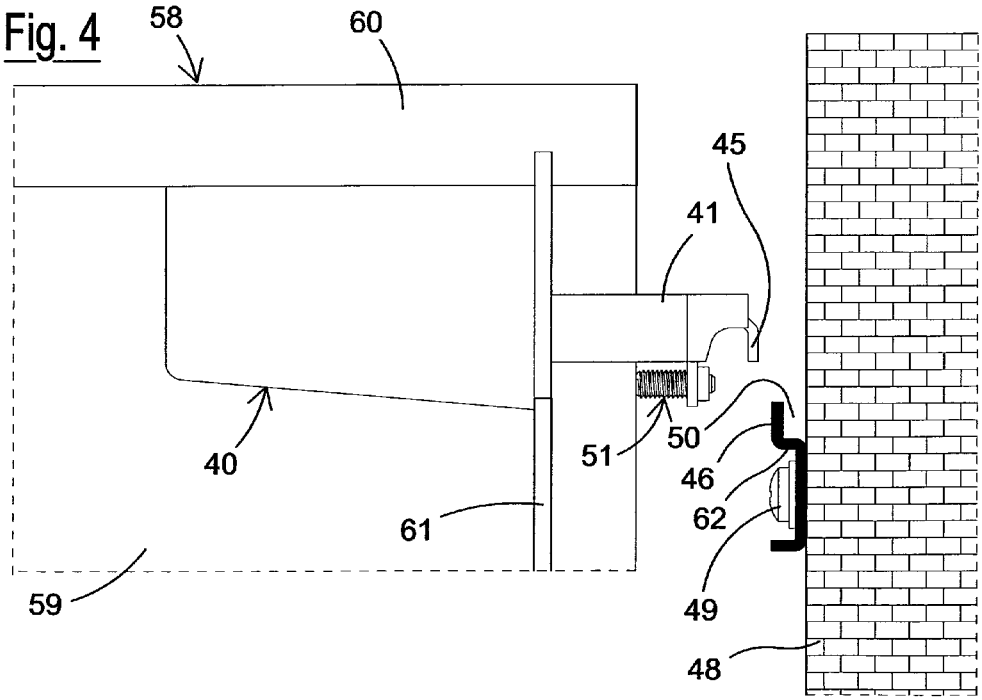
Figure 5:
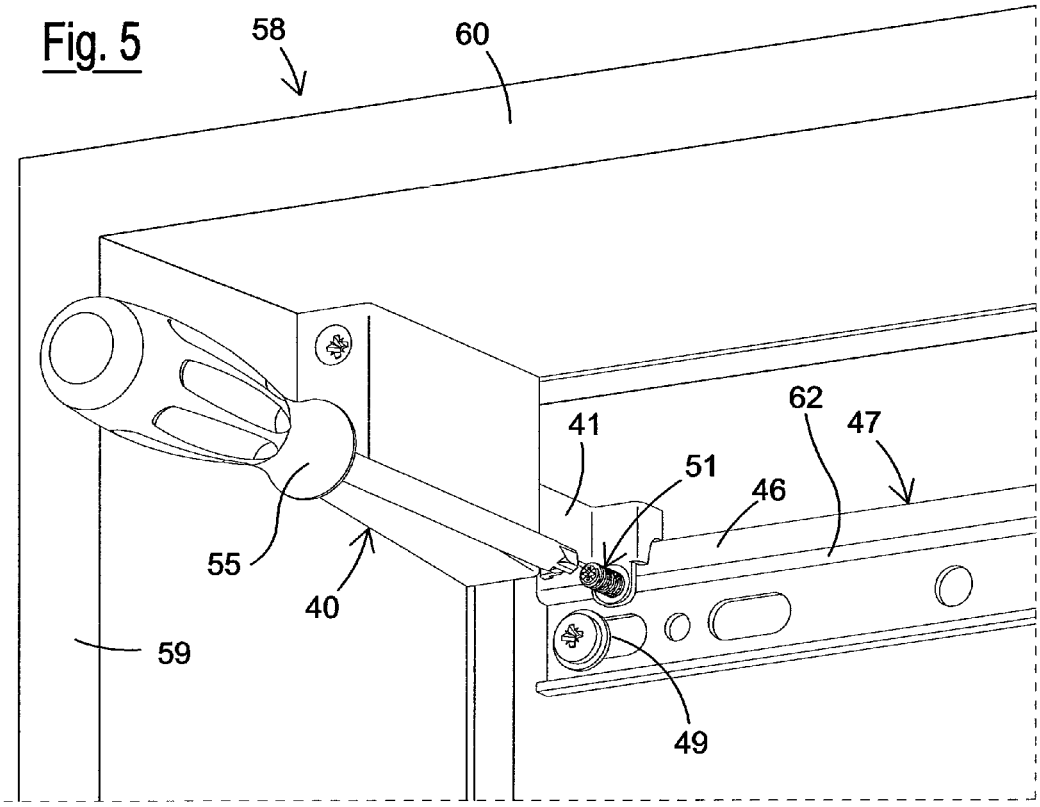
FIGS. 5-8 are views illustrating the system of FIGS. 3, 4 in the activation phases of the release-preventing system in the blocking position of the cupboard to the wall.
Figure 6:
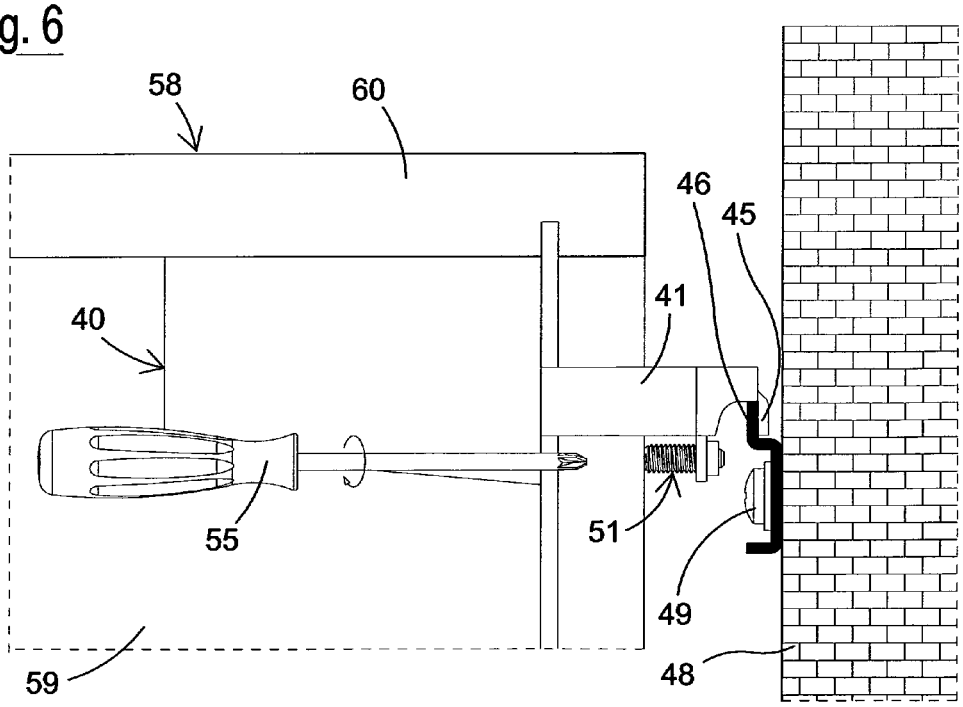
Figure 7:
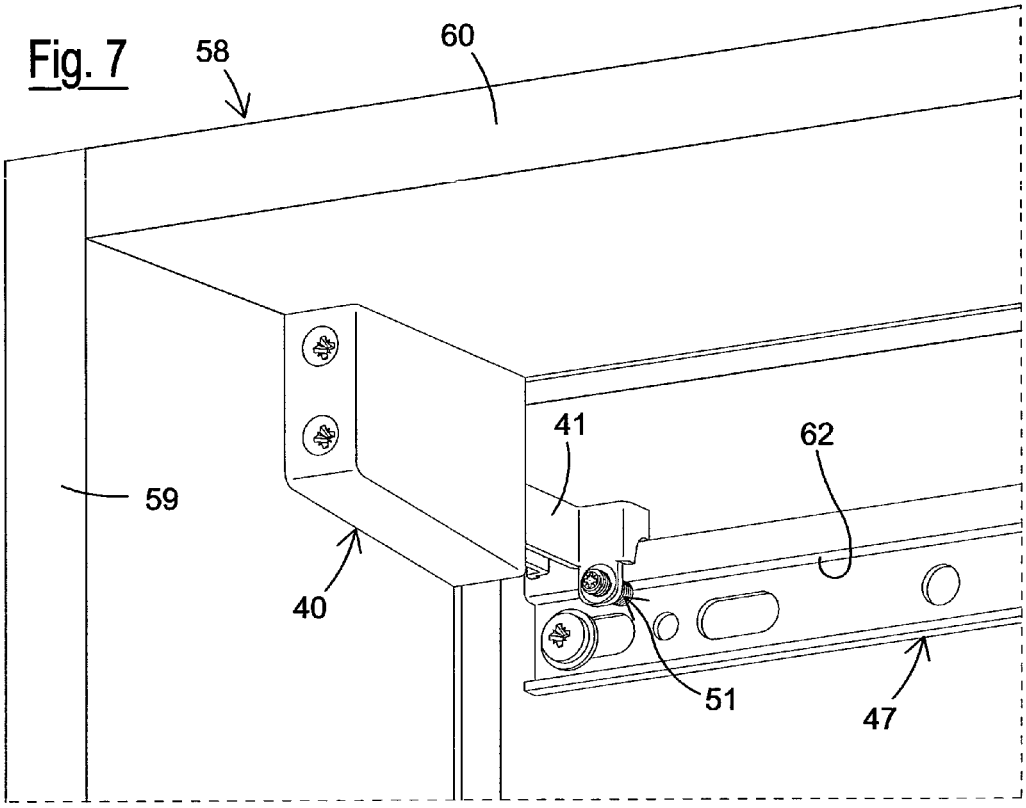
Figure 8:
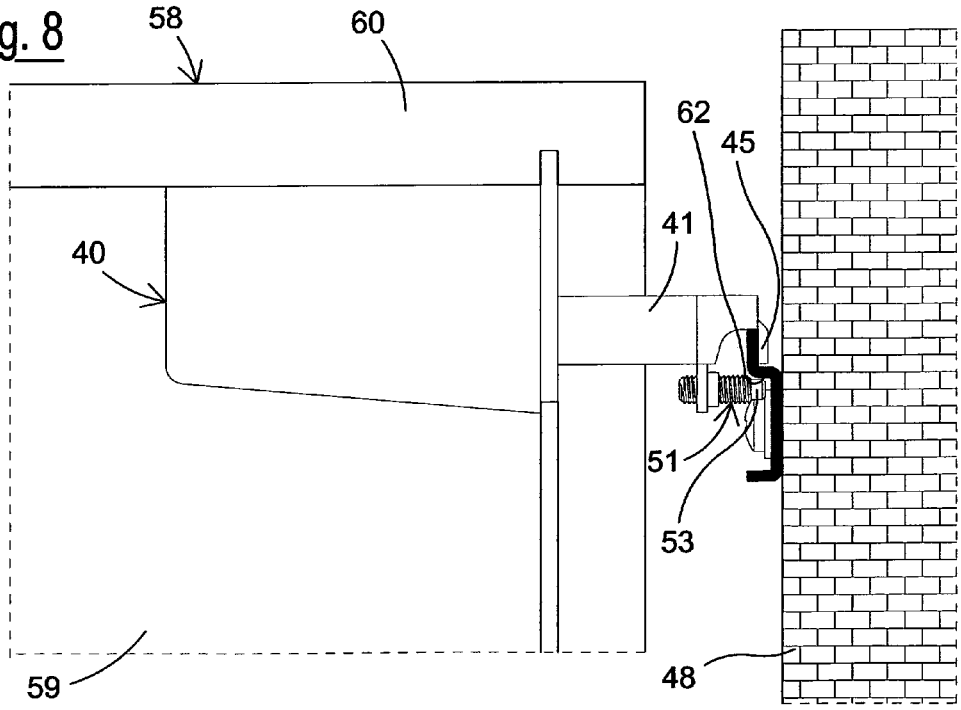
Figure 11:
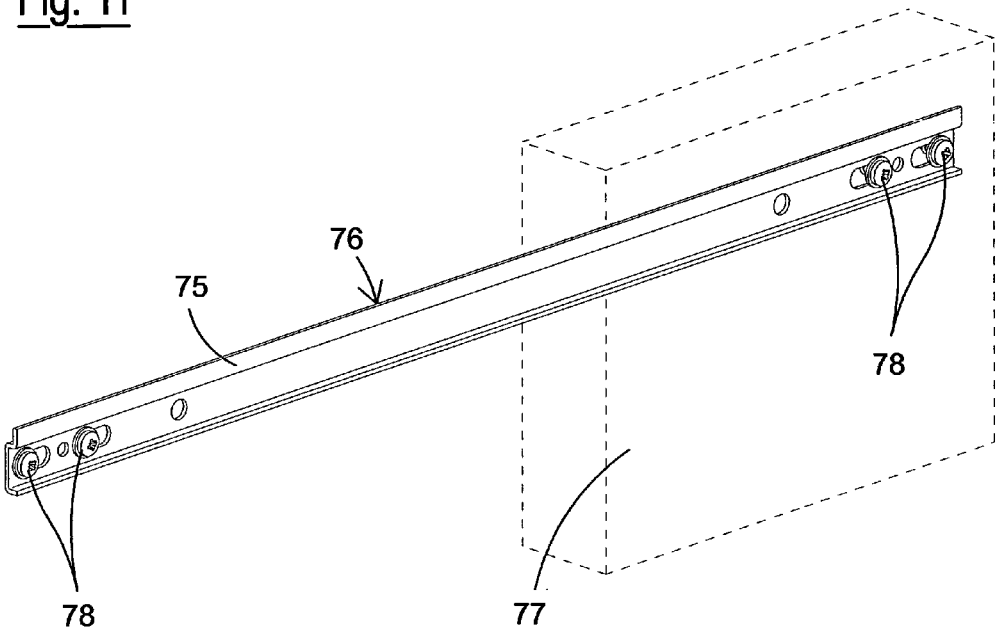
FIGS. 11-14 are perspective views illustrating a third possible embodiment of a release-preventing system according to the invention.

With the set-screw 51 in a rear non-operative position in FIGS. 3-6, the cupboard 58 is hooked to the wall 48, by inserting the tooth 45 of the hook 41 into the channel 50. In this way, due to the weight of the cupboard 58, the tooth 45 is engaged with the section 46 of the bar 47 (FIGS. 5, 6). With the cupboard 58 thus positioned, the set-screw 51 is screwed, by means of the screwdriver 55, into the operative forward position of FIGS. 7,8, thus causing the tip 53 to be inserted into the "C" shaped section of the bar 47, becoming engaged with the undercut formed by the horizontal upper wing 62 of the same.

It is therefore evident how, in the case of accidental application of direct upward forces to the cupboard 58, the interference between the set-screw 51 and the bar 47, prevents the unhooking of the tooth 45 from the section 46 of the bar 47 itself.

In the case of necessity, on the other hand, the deliberate releasing of the tooth 45 of the section 46 of the bar 47, is obtained by simply unscrewing the set-screw 51, bringing it back into the non-operative rear position of FIGS. 3, 4.

Figure 9:
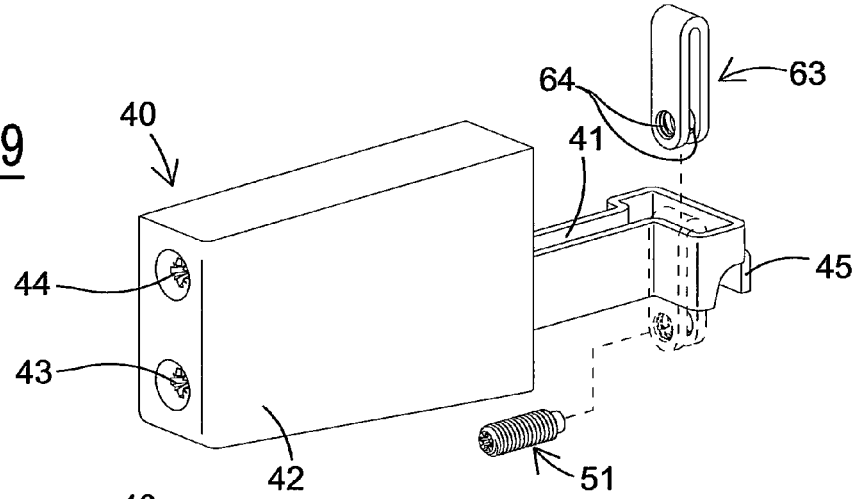
FIGS. 9, 10 are two views similar to FIGS. 1, 2 illustrating a second possible embodiment of a release-preventing system according to the invention.
Figure 10:
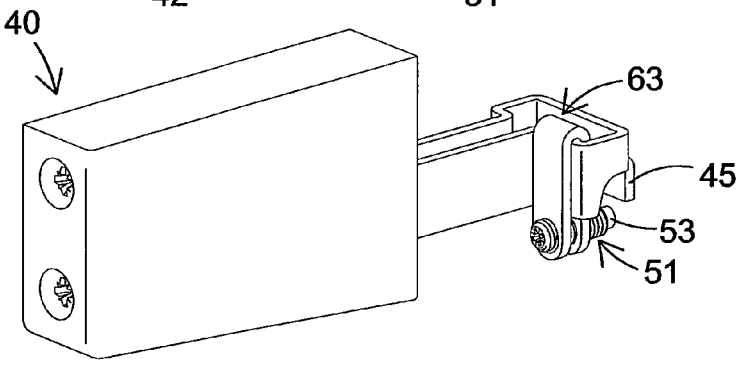

FIGS. 9, 10 show a second embodiment of the invention which is completely equivalent to that shown in FIGS. 1-8, with the only difference that, whereas in the embodiment of FIGS. 1-8, the flange 57 containing the threaded hole 56 is integral with the hook 41, in the embodiment of FIGS. 9, 10, there is a staple 63 which is removably inserted astride of the hook 41, as shown in the drawings. Said staple 63 is provided with aligned threaded holes 64 on which the set-screw 51 is screwed, operating in exactly the same way as that described with reference to FIGS. 1-8.

Figure 13:
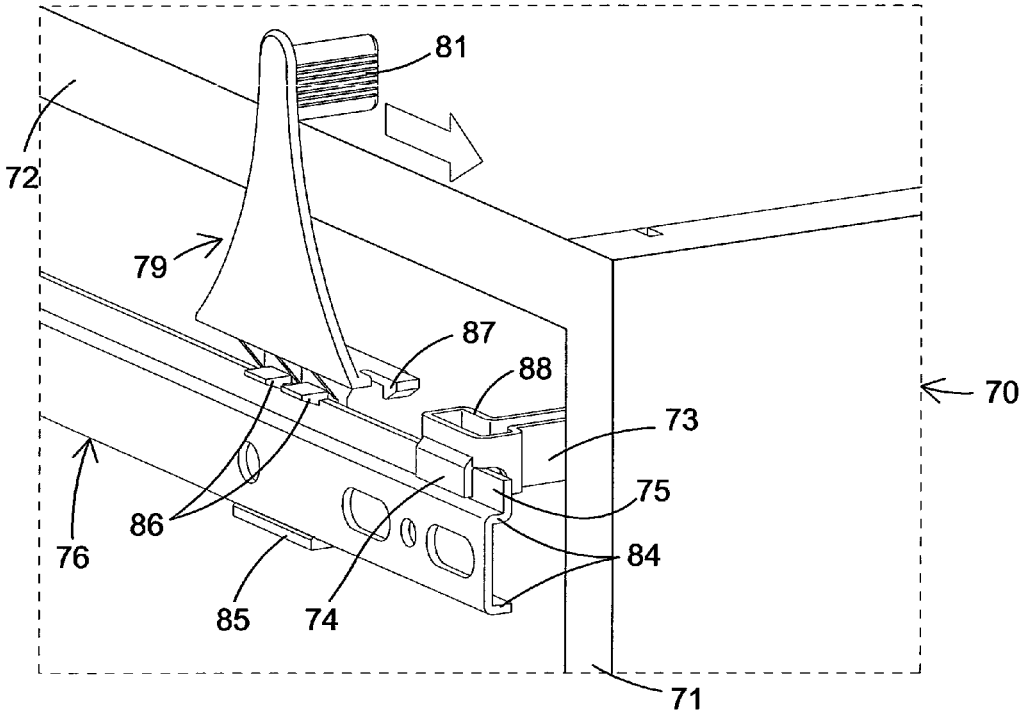
Figure 14:
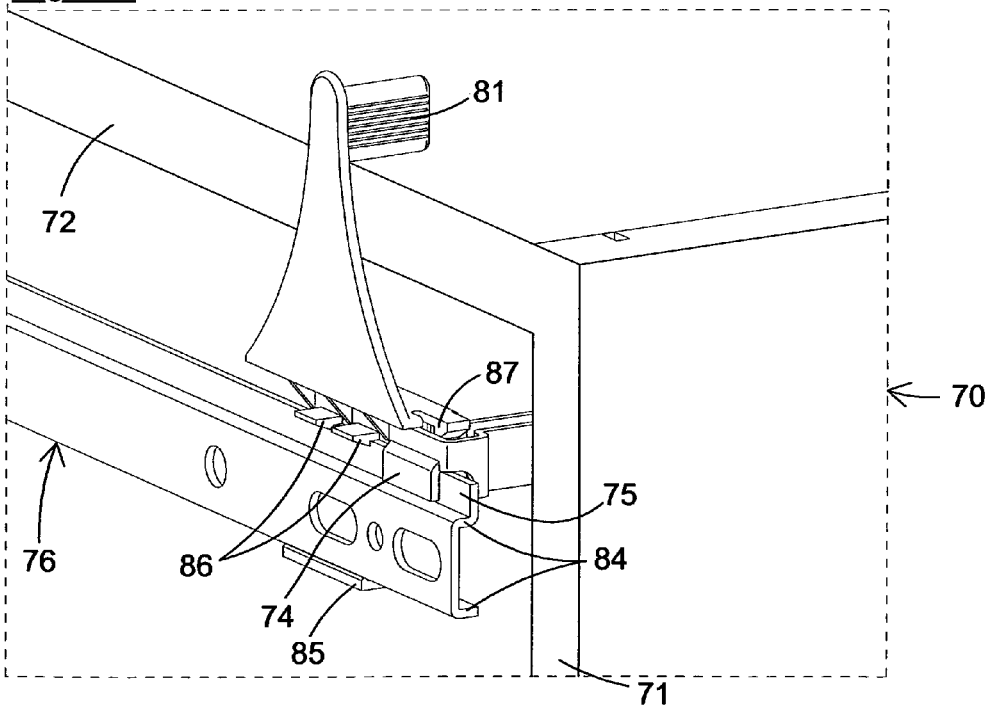
Figure 15:
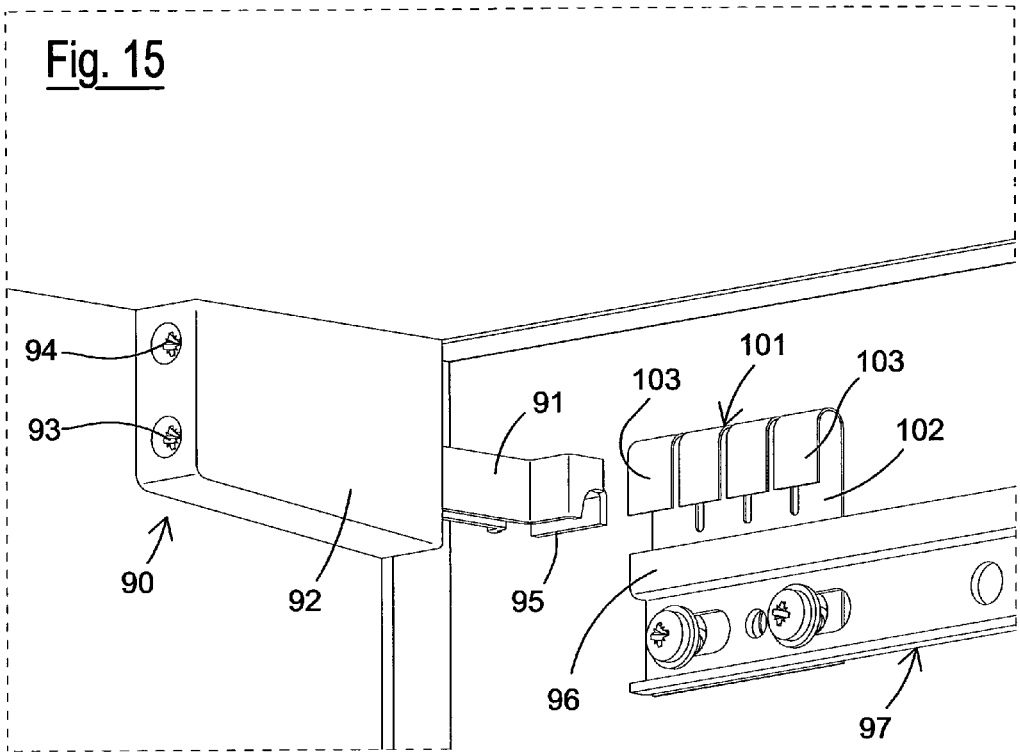
FIGS. 15-20 are views illustrating a fourth possible embodiment of a release-preventing system according to the invention.
Figure 16:
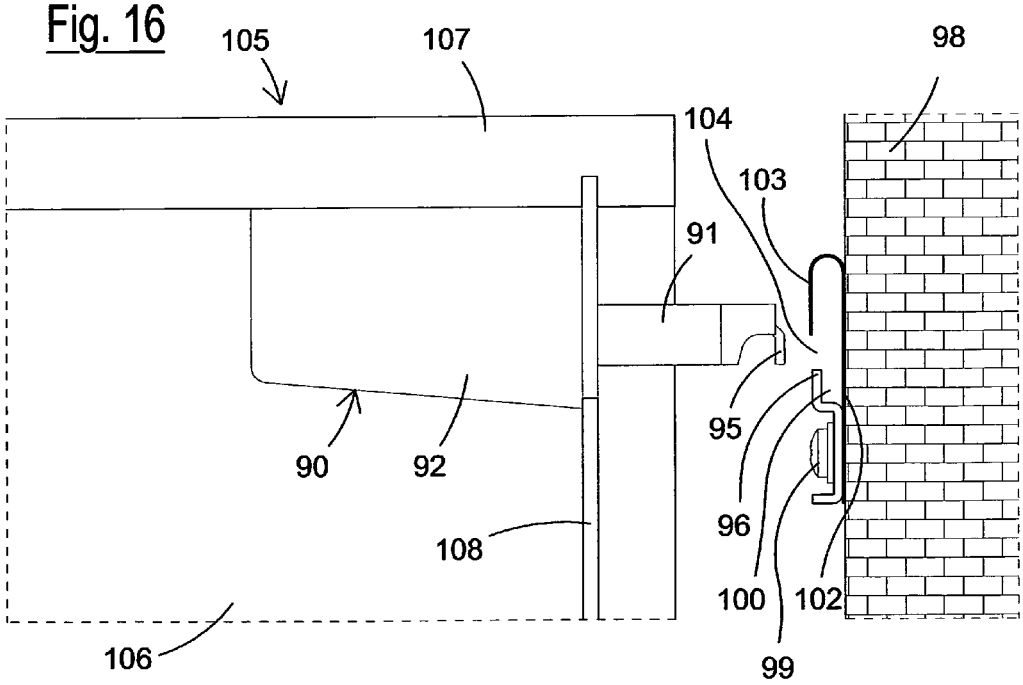
Figure 17:
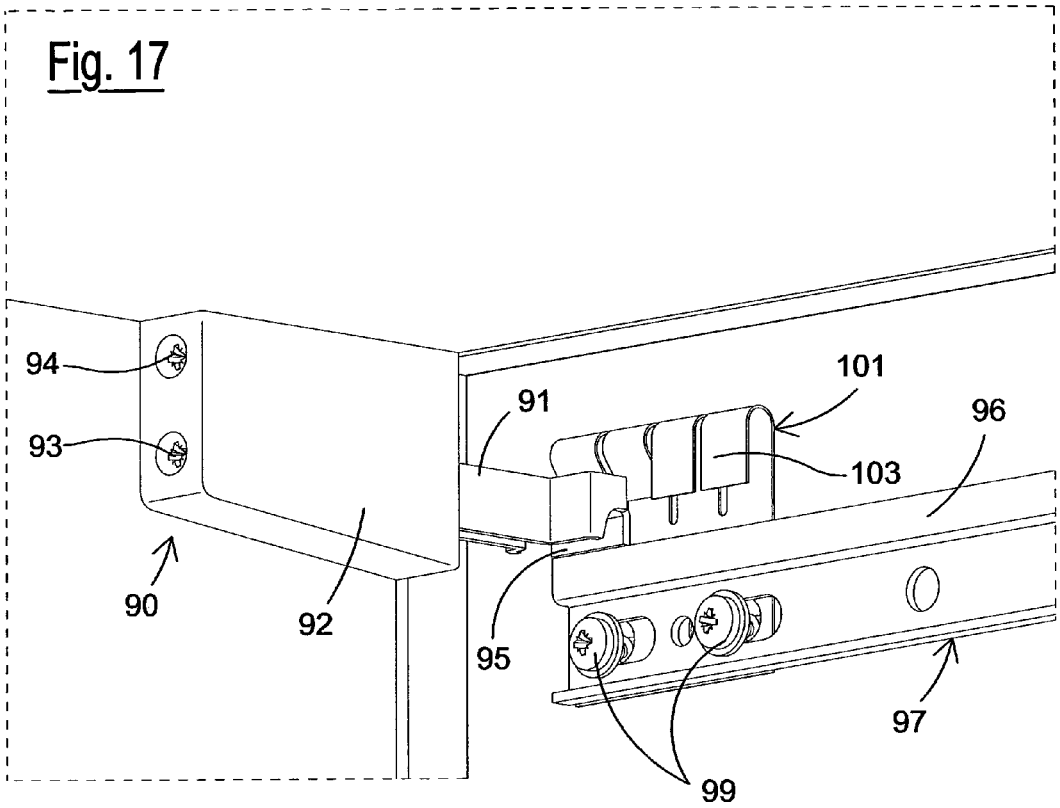
Figure 18:
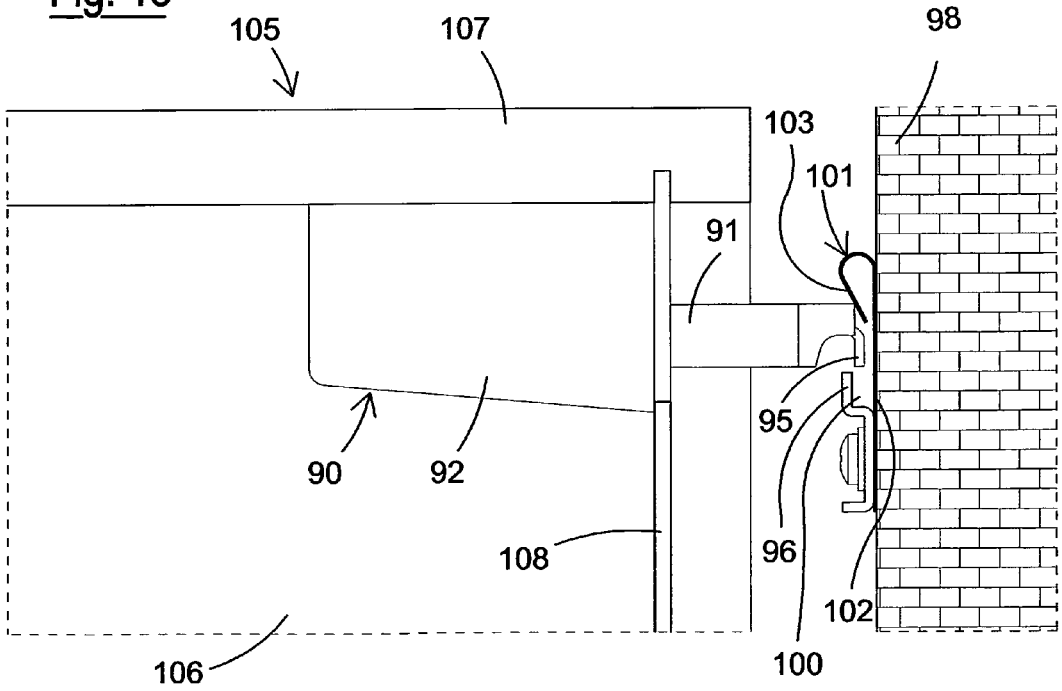
Figure 19:
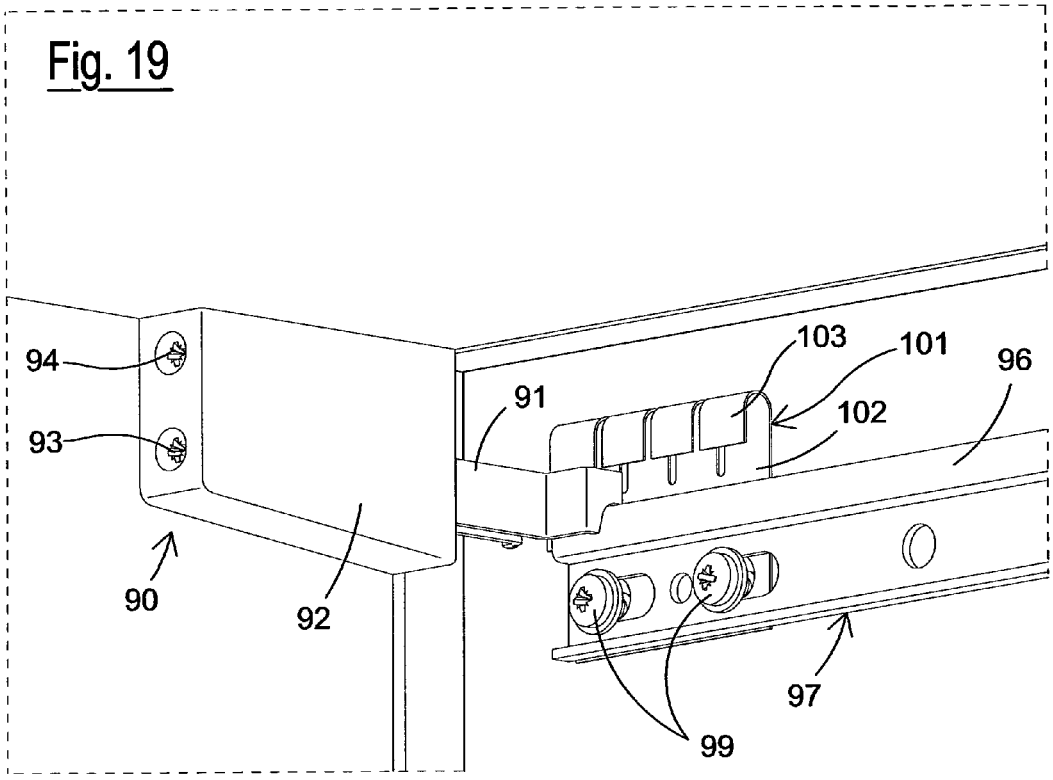
Figure 20:
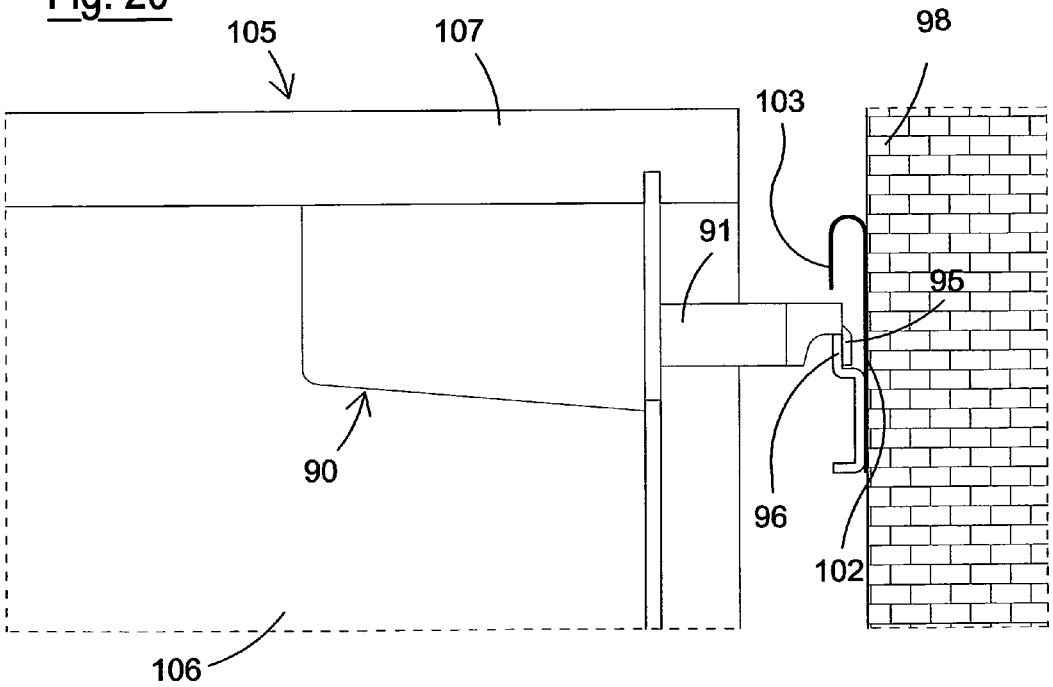
Figure 21:
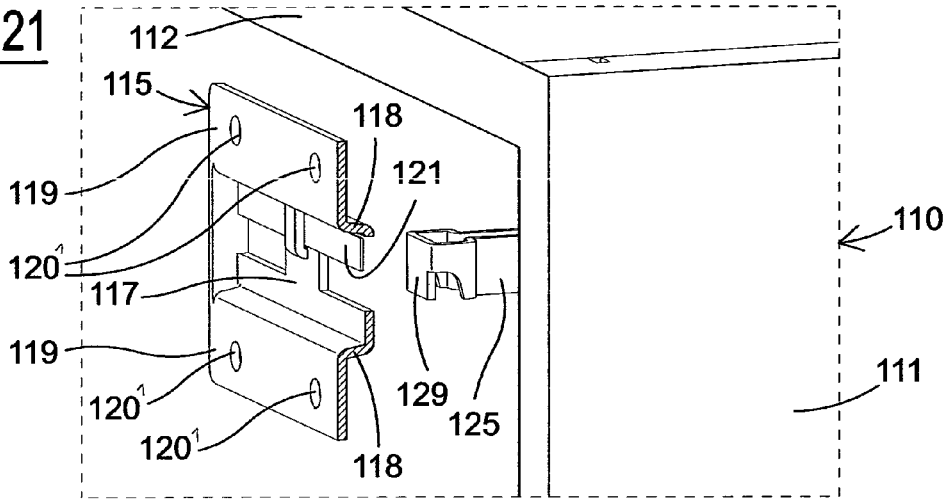
FIGS. 21-29 are views illustrating a fifth possible embodiment of a release-preventing system according to the invention.
Figure 22:
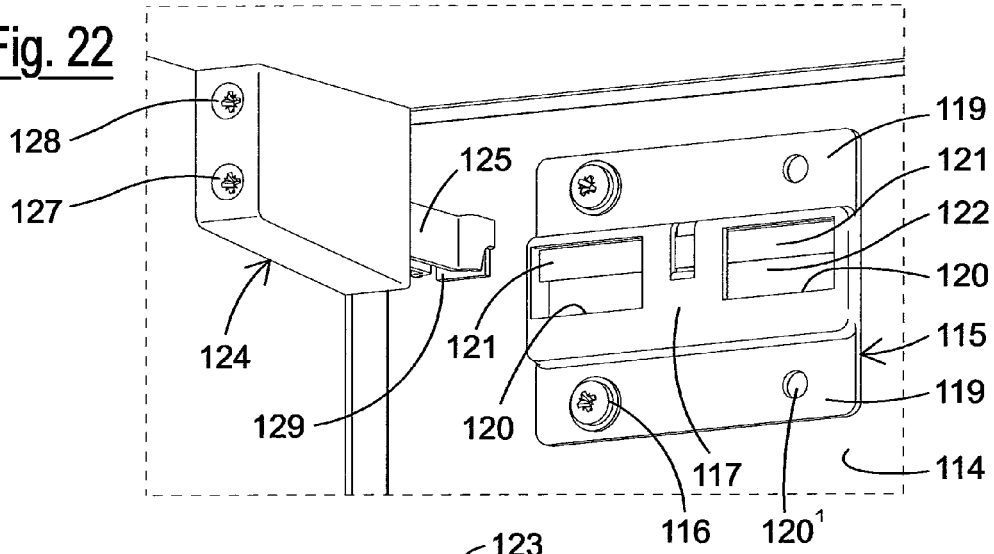
Figure 23:
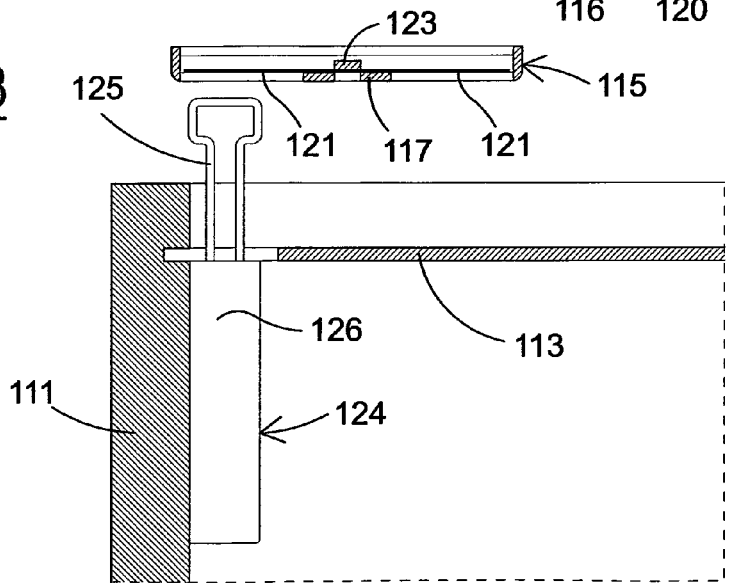

FIGS. 13, 14 partially illustrate a wall cupboard, indicated as a whole with 70, comprising a shoulder 71, a head 72 and possibly a rear cover (not shown). A cupboard holding device is fixed to each shoulder 71 of the cupboard 70, which, for example, can be of the type described and illustrated in patents EP 0033179 B1 and EP 0632979 A1.

Said cupboard holding device comprises a movable hook 73, which extends backwards from the cupboard and which is provided with a tooth 74.

The position of the hook 73 can be regulated in a known manner, in depth and height.

Said tooth 74 is destined for being hooked to a corresponding section 75 of a metallic bar 76 which can be fixed to a wall 77 by means of pegs 78.

Figure 12:
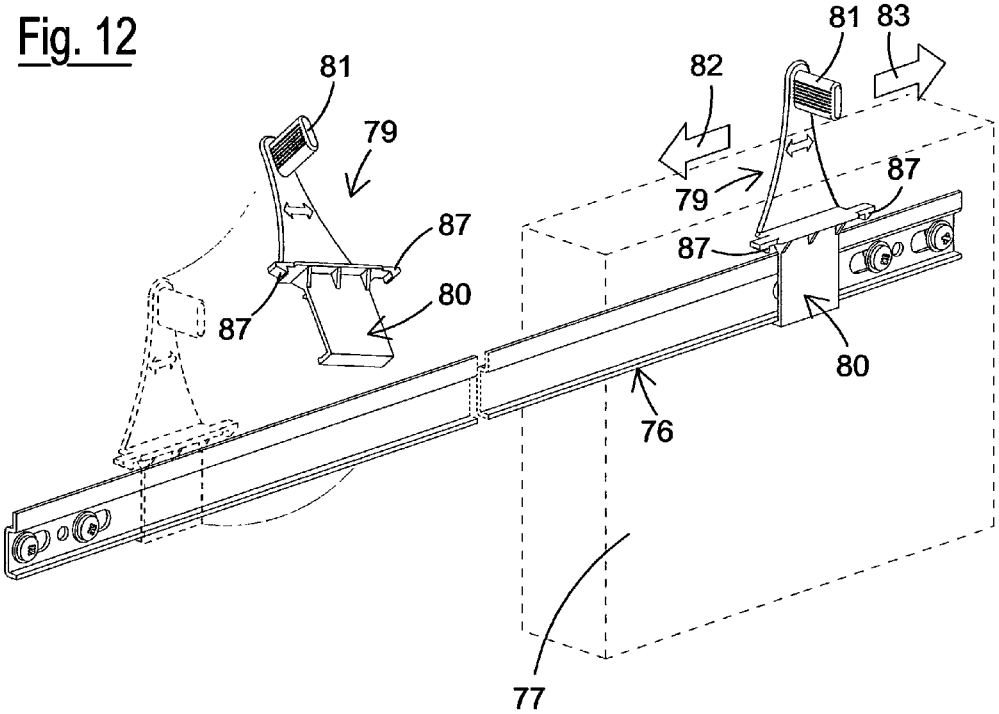

According to this third embodiment of the invention, a blocking device 79, preferably moulded in a single piece of plastic material (FIG. 12), is assembled on the bar 76, cooperating with the hook 73 in the sense of preventing its accidental unhooking from the bar 76 (FIGS. 13, 14).

More specifically, said blocking device 79 comprises a slider 80 and a manoeuvring handle 81, whereby the device can slide along the bar 76 in the directions of the arrows 82, 83. The bar 76 has a substantially "C" shaped section with wings 84, and the above hooking section 75 of the tooth 74 extends vertically from the upper wing 84. As can be clearly seen from the drawings, the above slider 80 is slidingly applied to the bar 76 by means of a lower section 85 and a pair of upper teeth 86, which are elastically yielding. The section 85 is applied to the lower wing 84 of the bar 76, whereas the teeth 86 are click-applied to the section 75.

The blocking device 79, at the base of the handle 81—practically between the slider 80 and the same handle 81—is equipped with opposing teeth 87, elastically yielding, situated above and parallel to the bar 76. As shown in the operative sequence of FIGS. 13, 14, with the cupboard 70 hooked to the bar 76, by means of the tooth 74 of the right and left cupboard holding devices, the handle 81 of the blocking device is easily accessible, protruding from the head 72. In this way, the slider 80 can slide in either direction, until one of the two teeth 87 become click-engaged with the front annular end 88 of the hook 73, superimposing it.

It is evident how the accidental unhooking of the tooth 74 from the bar 76 is prevented. If necessary, the tooth 87 can be freed from the hook 73, by means of a reverse manoeuvre of the slider 80, thus allowing the cupboard to be released from the bar 76.

FIGS. 15-20 illustrate a fourth possible embodiment of the invention.

In said FIGS. 15-20, 90 indicates as a whole a cupboard holding device of the type generally known, described for example in patents EP 033179 B1 and EP 0632979 A1, to which reference can be made.

The cupboard holding device 90 comprises a hook 91 which extends from a box-shaped body 92.

The regulation mechanism of the position in depth and height of the hook 91, by means of the respective screws 93, 94, is enclosed inside the box-shaped body 92.

The hook 91 ends at the front with a tooth 95 destined for being hooked to a corresponding section 96 of a metallic bar 97 (FIGS. 17-20) fixed to a wall 98 by means of pegs 99. As can be clearly seen from the drawings, the section where the tooth 95 is housed. The bar 97 has a "C" shaped section from whose upper wing the above section 96 extends vertically.

Characteristically, according to this fourth embodiment of the invention, a blocking device, indicated as a whole with 101, cooperates with the bar 97 and with the front annular part of the hook 91.

Said device 101 comprises a plate 102, fixed to the wall behind the bar 97, where there are a series of elastically yielding elements 103. As can be clearly seen from the drawings, said elements 103 are positioned above the section 96 of the bar, coplanar and at a certain distance from it, thus defining a passage 104 for the front end of the hook 91.

The blocking device 101 described above could also form part of the bar 97.

The functioning of this fourth embodiment of the invention is clear from what is described above and is briefly the following.

In the assembly phase of the cupboard to the wall, the elastic elements 103 are pushed from the front end of the hook 91, thus allowing the passage and engagement of the tooth 95 to the section 96 of the bar 97 (FIGS. 17-20). Once the tooth 95 is engaged with the section 96, the elastic elements 103 return automatically to their original rest position (FIGS. 19, 20), above the free end of the tooth 91, thus preventing its accidental unhooking, in the case of the application of upward forces to the cupboard 105. Said cupboard 105 comprises shoulders 106, a head 107 and a possible cover 108.

The flexibility of the elements 103, on the other hand, allows the intentional extraction of the hooks 91 through the passage 104, thus allowing the cupboard to be dismantled from the wall. For this purpose, it is sufficient to bend the elements 103 with a tool.

FIGS. 21-29 illustrate a fifth embodiment of the invention in which a cupboard 110, only partially shown, comprises shoulders 111, a head 112 and a possible cover 113. Said cupboard 110 is hung to a wall 114 by means of plates 115 fixed to the wall 114 itself by means of pegs 116.

As can be clearly seen from the drawings, said plates 115 comprise a central "C" shaped section with a core 117 and wings 118.

Flanges 119 with holes 12O[1] for fixing the plate 115 to the wall 114 by means of the pegs 116, extend from the wings 118.

The core 117 has at least one opening 120, in the example shown, there are two openings 120, partially closed in the upper half by an elastically yielding metallic lamina 121.

The openings 120 and the lamina 121 define passages 122. Said flexible lamina 121 bends (to the right or left) around a central constraint 123 of the core 117.

The cupboard 110 is hooked to the plate 115 by means of a cupboard holding device 124 of the type generally known, as described for example in patents EP 0033179 B1 and EP 0632979 A1.

The cupboard holding device 124 comprises a movable hook 125 which extends from a box-shaped body 126.

The regulation mechanism of the position in depth and height of the hook 125 by means of respective screws 127, 128, is enclosed inside the box-shaped body 126.

The hook 125 ends at the front with a tooth 129 suitable for being hooked to the plate 115, as is illustrated in the drawings.

More specifically, the front end of the hook 125 is inserted in the opening 120 by bending the flexible lamina 121 (FIGS. 24-26) thus allowing the tooth 129 to be hooked to the core 117 of the plate 115. In this position of the tooth 129, the lamina 121 is no longer under stress and returns to the rest position of FIGS. 27-28, above the hook 125, thus preventing an accidental disengagement of the plate 115.

Figure 24:
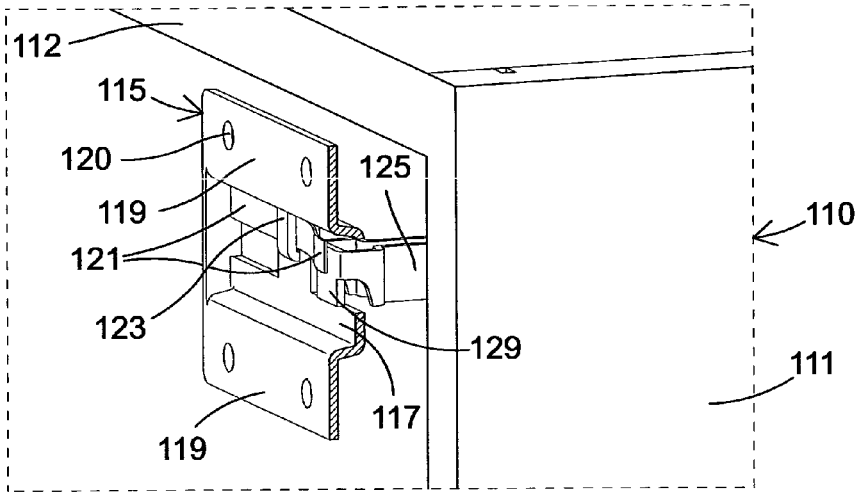
Figure 25:
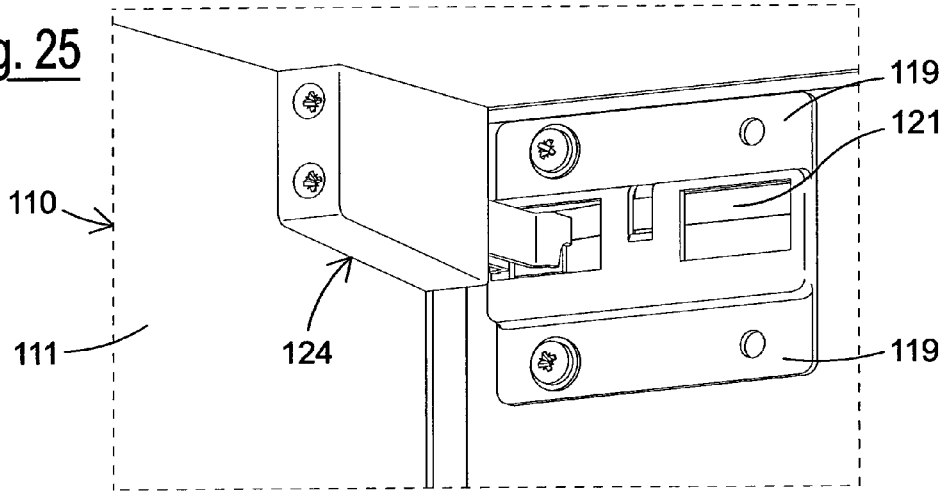
Figure 26:
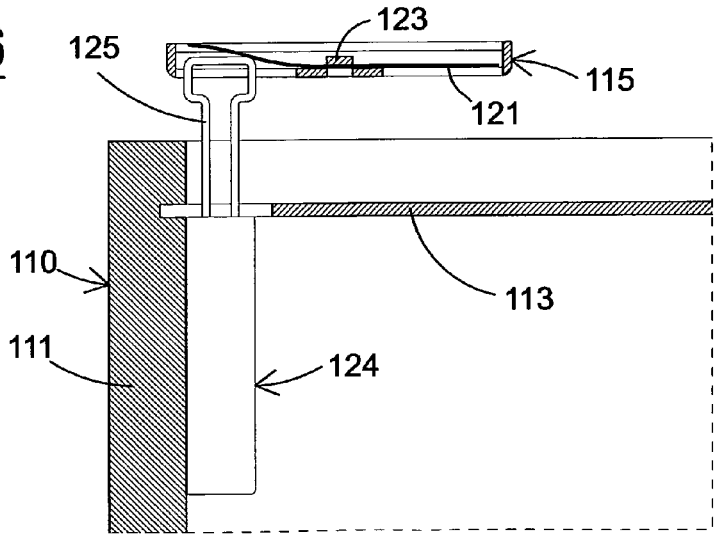
Figure 27:
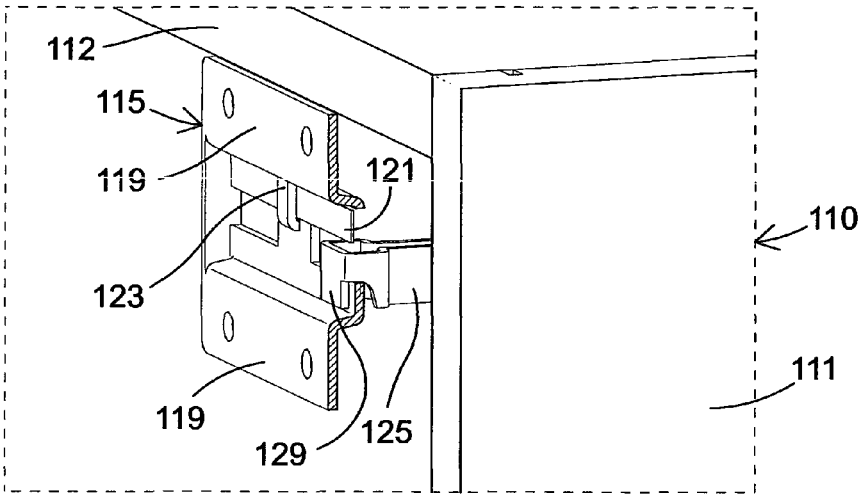
Figure 28:
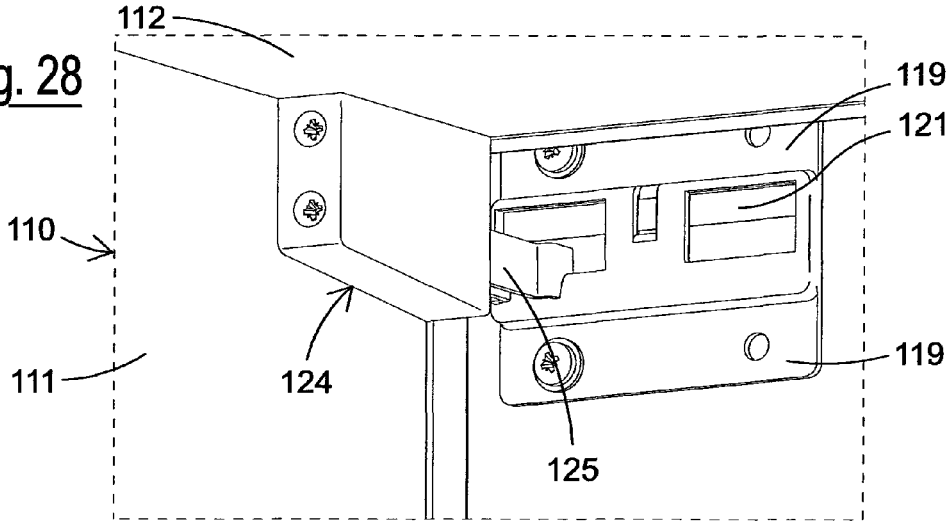
Figure 29:
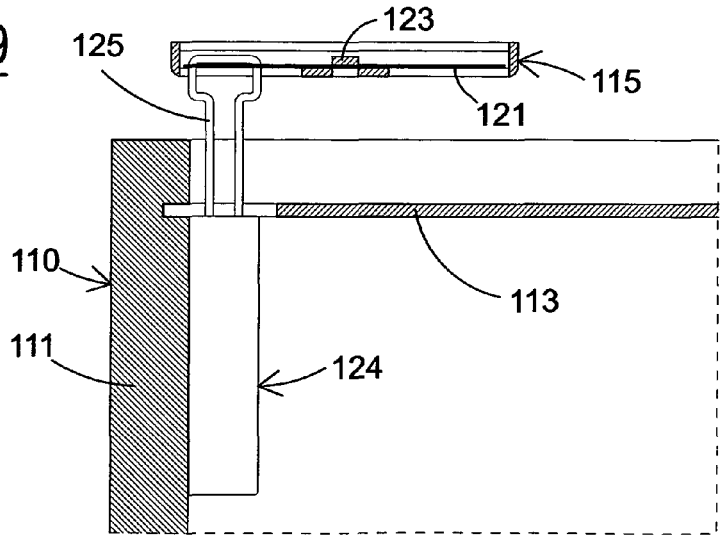

In order to unhook the cupboard from the wall, it is sufficient to bend the flexible lamina 121 with a tool in the position of FIGS. 24-26, allowing the tooth 129 to be disengaged from the core 117 of the plate 115.

Figure 30:
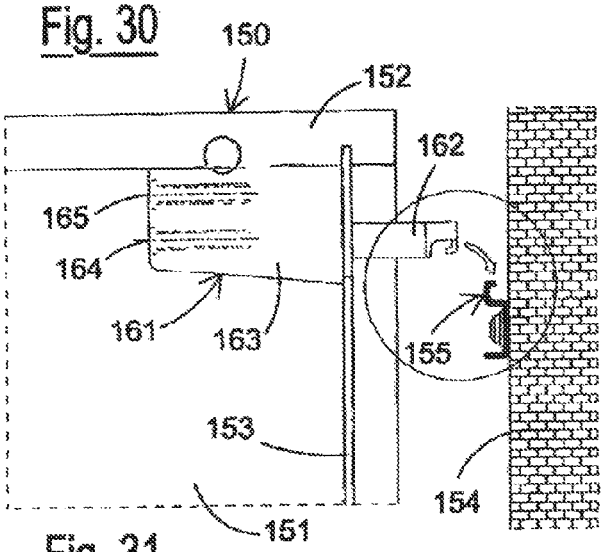
FIGS. 30-32 are views illustrating a sixth possible embodiment of a release-preventing system according to the invention.
Figure 33:
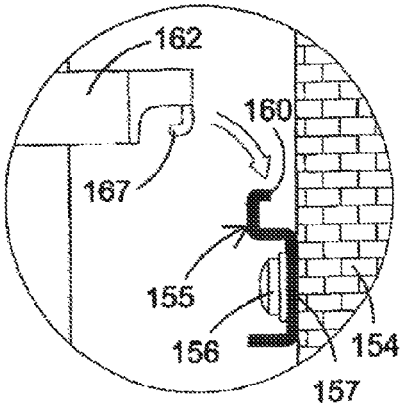
FIGS. 33-35 are enlarged details of FIGS. 30-32 respectively.
Figure 31:
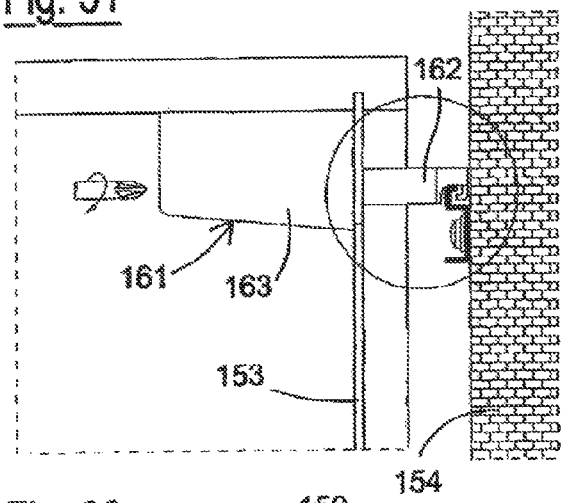
Figure 34:
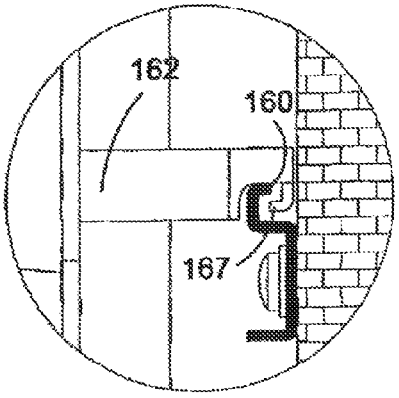
Figure 32:
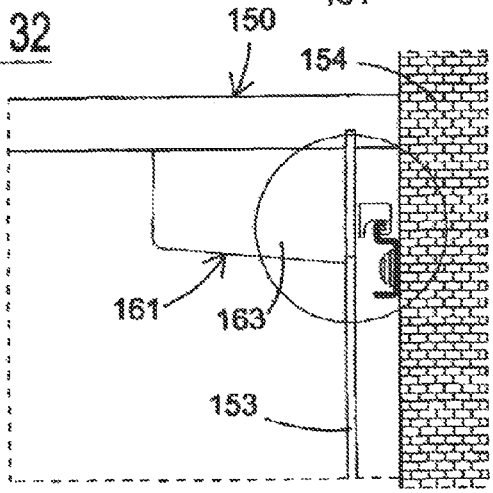
Figure 35:
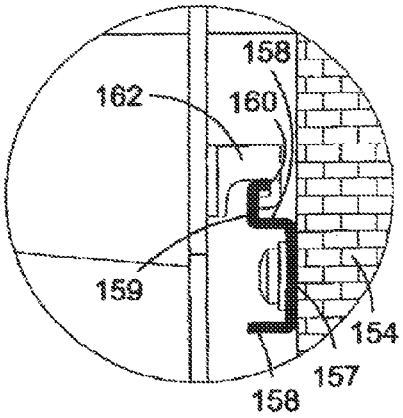

FIGS. 30-32 are views illustrating a sixth embodiment of the invention in which a cupboard 150, only partially shown, comprises shoulders 151, a head 152 and a possible cover 153. Said cupboard 150 is hung to a wall 154 by means of a support 155 (bar or plate) fixed to the wall 154 by means of pegs 156.

As can be clearly seen from the drawings, said support 155 comprises a "C" shaped section with a central core 157 and wings 158. A section 159 extends vertically from the upper wing 158 and ends with a flap 160 parallel to the wing itself 158.

The cupboard 150 is hooked to the support 155 by means of the cupboard holding device 161 of the type generally known, described for example in patents EP 0033179 B1 and EP 0632979.

The cupboard holding device 161 comprises a movable hook 162 which extends from a box-shaped body 163. The regulation mechanism of the position in depth and height of the hook 162 by means of respective screws 164, 165, is enclosed inside the box-shaped body 163.

The hook 162 ends at the front with a hooked tooth 167 substantially complementary to the flap 160 of the support 155.

In this way, after hanging the cupboard on the wall, as shown in FIGS. 30, 31, the hook 162 is regulated in depth, and consequently the hooked flap 167 is firmly hooked to the flap 160 of the support 155 in order to prevent the accidental unhooking of the cupboard from the wall.

To be able to unhook the cupboard from the wall, it is sufficient to act in the opposite direction to the depth regulation of the hook 162.

The objectives mentioned in the preamble of the description are thus achieved.

The protection scope of the present invention is defined by the enclosed claims.

The invention claimed is:

1. A release-preventing system for a wall cupboard, wherein a cupboard (40, 70, 105, 110, 150) is hooked to a support (47, 76, 97, 115, 155) fixed to a wall (48, 77, 98, 114, 154) by a hook (41, 73, 91, 125, 162) of a cupboard holding device (40, 90, 124, 163) wherein between said hook (41, 73, 91, 125, 162) and said support (47, 76, 97, 115, 155) a release-preventing element is included characterized in that said release-preventing element consists of an elastically yielding sheet (121) applied to said support (115), said elastically yielding sheet being suitable to interfere with said hook (125) by bending to the right or left around a central constraint before returning to a rest position above said hook (125).

2. A release-preventing system for a wall cupboard, wherein a cupboard (40, 70, 105, 110, 150) is hooked to a support (47, 76, 97, 115, 155) fixed to a wall (48, 77, 98, 114, 154) by a hook (41, 73, 91, 125, 162) of a cupboard holding device (40, 90, 124, 163) characterized in that between said hook (41, 73, 91, 125, 162) and said support (47, 76, 97, 115, 155) are included a release-preventing element (51, 79, 101, 121, 160, 167) that prevents undesired unhooking of said cupboard wherein said release preventing element consist of a set-screw (51) screwed on said hook (41) and suitable to interfere with said support (47) wherein said set-screw (51) is screwed inside a threaded seat (56) provided on a flange (57) that protrudes downwardly from said hook (41), the flange (57) being opposed to a tooth (45) of said hook (41) and being placed at a suitable height below said hook (41), so that when said set-screw (51) is in a backward position, and a piece of furniture (58) is hooked to the wall (48), then the set-screw (M) is screwed in an advanced position, so that a tip of the set screw is blocked on the support (47), interfering with the same.

3. The system according to claim 2, characterized in that said support (47) is a bar having a "C-shaped" section with a section (46) on which the tooth (45) of said hook (41) is hooked, and the tip (53) of said set-screw (51) in an advanced position is engaged to said "C-shaped" section.

4. A release-preventing system for wall cupboard, wherein a cupboard (40, 70, 105, 110, 150) is hooked to a support (47, 76, 97, 115, 155) fixed to a wall (48, 77, 98, 114, 154) by a hook (41, 73, 91, 125, 162) of a cupboard holding device (40, 90, 124, 163) wherein between said hook (41, 73, 91, 125, 162) and said support (47, 76, 97, 115, 155) include a release-preventing element, and a blocking device (79) applied to said support (76) and suitable to interfere with said hook (73) characterized in that said blocking device (79) can slide on said support (76) between a stand up position separated by said hook (73) to an operative position wherein the blocking device (79) is coupled to the hook (73) in the sense of preventing the accidental unhooking from a bar (76).

5. The system according to claim 4, characterized in that said blocking device (79) comprises a slider (80) and a manoeuvring handle (81) protruding from an upper part of the cupboard, through which said blocking device (79) can slide in two directions (82, 83) along the bar (76).

6. The system according to claim 5, characterized in that said bar (76) has a is substantially "C-shaped" with upper wing (84*a*) and lower wing (84*b*), and a section (75) for hooking a tooth (74) of a vertically protruding hook (73) to the upper wing (84*a*) of said substantially "C-shaped" bar, said slider (80) being applied, in a sliding manner, to the "C-shaped" bar (76) by means of a lower section (85) and upper elastically yielding teeth (86), the section (85) being applied to the lower wing (84*b*) of the bar (76), whereas the upper elastically yielding teeth (86) are click applied to the section (75), said device (79) at the base of the handle (81), between the slider (80) and the handle being equipped with two elastically yielding opposing teeth (87), lying above the bar (76) and parallel to said bar, so that the slider (80) can slide in both directions, until one of said two elastically yielding teeth (87) is click engaged to an annular anterior end (88) of the hook (73), overhanging it.

7. The system according to claim 4, characterized in that said support (76) has a substantially "C-shaped" section with upper wing (84*a*) and lower wing (84*b*) and a hooking section (75) of a tooth (74) of the hook (73) vertically protruding from said upper wing (84*a*) of the "C-shaped", said blocking device (79) being applied, in a sliding manner, to the support (76) by a lower section (85) of said blocking device (79) and elastically yielding upper teeth (86), the lower section (85) being applied to said lower wing (84*b*) of the support (76), whereas the teeth (86) are click applied to the section (75), said blocking device (79) being equipped with two elastically yielding opposing teeth (87), lying above the support (76), so that said blocking device (79) can slide in two directions, until one of the two elastically yielding opposing teeth (87) is click engaged to an anterior annular end (88) of said hook (73).

8. A release-preventing system for a wall cupboard, wherein a cupboard (40, 70, 105, 110, 150) is hooked to a support (47, 76, 97, 115, 155) fixed to a wall (48, 77, 98, 114, 154) by a hook (41, 73, 91, 125, 162) of a cupboard holding device (40, 90, 124, 163) wherein between said hook (41, 73, 91, 125, 162) and said support (47, 76, 97, 115, 155) a release-preventing element is included characterized in that said release-preventing element consists of an elastically yielding sheet (121) applied to said support (115), said elastically yielding sheet being suitable to interfere with said hook (125) characterized in that said release-preventing element consists of a device (101) applied to said support (97) where said device (101) is suitable to interfere with said hook (91) wherein said device (101) comprises a sheet (102) protruding from an upper part of the support (97), from which sheet (102) a series of elastically yielding elements (103) is positioned above the support (97) so as to find a passage (104) for an anterior end of the hook (91) comprising a tooth (95) suitable to hook to a section (96) of said support (97), so that during the attachment of the cupboard to the wall, the elastic elements (103) are pushed by the anterior end of the hook (91), so as to allow the passage and the engagement of the tooth (95) to the section (96) of the support (97) with said elastic elements (103) which automatically come back to an original resting position above a free end of the hook (91) so as to prevent accidental unhooking of said cupboard.

9. A release-preventing system for a wall cupboard, wherein a cupboard (40, 70, 105, 110, 150) is hooked to a support (47, 76, 97, 115, 155) fixed to a wall (48, 77, 98, 114, 154) by a hook (41, 73, 91, 125, 162) of a cupboard holding device (40, 90, 124, 163) wherein between said hook (41, 73, 91, 125, 162) and said support (47, 76, 97, 115, 155) a release-preventing element is included characterized in that said release-preventing element consists of an elastically yielding sheet (121) applied to said support (115), said elastically yielding sheet being suitable to interfere with said hook (125) characterized in that said elastically yielding metal sheet (121) is part of a plaque (115) supporting the cupboard, said plaque (115) comprising a central "C-shaped" section with a core (117) and wings (118) from which flanges (119) protrude with holes ($\mathbf{120}^1$) for the passage of pegs (116) through the plaque (115) to a wall (114), said core (117) presenting at least one opening (120) partially closed by said metal sheet (121) so as to form a passage (122) for a hook (125) protruding from said cupboard holding device (124), said hook (125) ending in the front with a tooth (129) suitable to be hooked through said opening (120) by inflecting the flexible sheet (121), so as to hook the tooth (129) to the core (117) of the plaque (115), wherein said sheet (121) returns to a stand by position above said hook (125).

10. A release-preventing system for a wall cupboard, wherein a cupboard (40, 70, 105, 110, 150) is hooked to a support (47, 76, 97, 115, 155) fixed to a wall (48, 77, 98, 114, 154) by a hook (41, 73, 91, 125, 162) of a cupboard holding device (40, 90, 124, 163) wherein between said hook (41, 73, 91, 125, 162) and said support (47, 76, 97, 115, 155) a release-preventing element is included characterized in that said release-preventing element consists of an elastically yielding sheet (121) applied to said support (115), said elastically yielding sheet being suitable to interfere with said hook (125) characterized in that said release-preventing element comprises a hook (172) ending, in an anterior part, with a hook tooth (167) suitable to be engaged to a complementary flap (160) of the support (155).

* * * * *